US007671703B1

(12) United States Patent
Vezmar

(10) Patent No.: US 7,671,703 B1
(45) Date of Patent: Mar. 2, 2010

(54) COAXIAL ORTHOMODE TRANSDUCER

(75) Inventor: John Michael Vezmar, Hickory, NC (US)

(73) Assignee: General Dynamics C4 Systems, Inc., Scottsdale, AZ (US)

( * ) Notice: Subject to any disclaimer, the term of this patent is extended or adjusted under 35 U.S.C. 154(b) by 83 days.

(21) Appl. No.: 11/808,354

(22) Filed: Jun. 8, 2007

(51) Int. Cl.
*H01P 5/12* (2006.01)

(52) U.S. Cl. ..... 333/125; 333/21 A; 333/21 R

(58) Field of Classification Search ..... 333/125, 333/126, 134, 135, 21 A, 21 R
See application file for complete search history.

(56) References Cited

U.S. PATENT DOCUMENTS

| | | | | |
|---|---|---|---|---|
| 5,003,321 | A | 3/1991 | Smith et al. | |
| 5,041,840 | A | 8/1991 | Cipolla et al. | |
| 6,211,750 | B1 * | 4/2001 | Gould | 333/21 A |
| 6,323,819 | B1 * | 11/2001 | Ergene | 343/786 |
| 6,720,933 | B2 | 4/2004 | Hanlin et al. | |
| 7,102,581 | B1 | 9/2006 | West | |

* cited by examiner

*Primary Examiner*—Robert Pascal
*Assistant Examiner*—Kimberly E Glenn
(74) *Attorney, Agent, or Firm*—Hunton & Williams LLP

(57) ABSTRACT

A coaxial orthomode transducer with improved port to port isolation, low higher order mode ("HOM") coupling, and low transverse electromagnetic mode ("TEM") coupling is disclosed.

17 Claims, 4 Drawing Sheets

COAXIAL ORTHOMODE TRANSDUCER

FIELD OF THE INVENTION

The present invention relates generally to coaxial transducers and more specifically to coaxial orthomode transducers ("OMTs") with improved port to port isolation, low higher order mode ("HOM") coupling, and low transverse electromagnetic mode ("TEM") coupling.

BACKGROUND OF THE INVENTION

Satellite communications have many practical applications for a device that operates in two or more frequency bands. Many devices have been employed to realize dual band frequency and/or multi-band frequency operation including frequency selective sub-reflectors, broad band feed networks, and coaxial orthomode transducers.

Typically, in the past, coaxial OMTs have been designed with circular inner conductors and circular outer conductors. To separate the lower frequency band polarizations, these designs utilized axially co-located ports, probes, or axially separate ports with tuning screws. Axially co-located ports may be the best technical solution but are very expensive to manufacture. Probe or tuned solutions may be less expensive to realize, however, tend to have poor port to port isolation and return loss. Additionally, these solutions also couple to HOM's and/or the undesired TEM mode.

A disadvantage of the undesired TEM mode includes the generation of cross-polarized electromagnetic signal components as a result of slight asymmetries in the conductor(s). Cross-polarization components may negatively effect efficient electromagnetic signal propagation. Cross-polarization components may be created by a rotation of the principal plane of the electromagnetic signals propagating through the conductor from the desired plane to a plane between the desired plane and the plane of the cross-polarization components. This rotation of the polarization plane results in power transfer to the cross polarized component, thus causing a decrease in efficiency.

A disadvantage of the HOM includes the propagation of electromagnetic signals at velocities other than the desired velocity for efficient electromagnetic signal transmission. High HOM coupling, therefore, also results in a decrease in efficiency.

SUMMARY OF THE INVENTION

Accordingly, at least one exemplary embodiment is directed to a transducer device. This embodiment may include a first port for receiving and propagating electromagnetic signals associated with a first polarization and electromagnetic signals associated with a second polarization, the first port may include an inner portion coaxially arranged with an outer portion longitudinally extending from one end of the first port to an opposite end of the first port, wherein the inner portion may include a first shape and the outer portion may include a second shape different from the first shape.

Another embodiment may provide an antenna feed. This embodiment may include a coaxial orthomode transducer including a common port coupled to a front port and orthogonally coupled to a rear port, the common port may include a inner portion coaxially arranged with an outer portion longitudinally extending from one end of the common port to an opposite end of the common port, the common port may be configured to receive, transmit, and propagate horizontally polarized and vertically polarized electromagnetic signals, wherein the inner portion may include a first shape and the outer portion may include a second shape different from the first shape.

An additional embodiment may provide an antenna feed comprising a coaxial orthomode transducer including a common port coupled to a front port and orthogonally coupled to a rear port, the common port including a cylindrical inner portion coaxially arranged with a rectangular outer portion longitudinally extending from one end of the common port to an opposite end of the common port, and the common port may be configured to receive, transmit, and propagate horizontally polarized and vertically polarized electromagnetic signals, wherein the front port propagates horizontally polarized and vertically polarized electromagnetic signals and the rear port propagates horizontally and vertically polarized electromagnetic signals.

These and other embodiments and advantages of the various embodiments of the present inventions will become apparent from the following detailed description, taken in conjunction with the accompanying drawings, illustrating by way of example the principles of the inventions.

DETAILED DESCRIPTION

Figure 1:
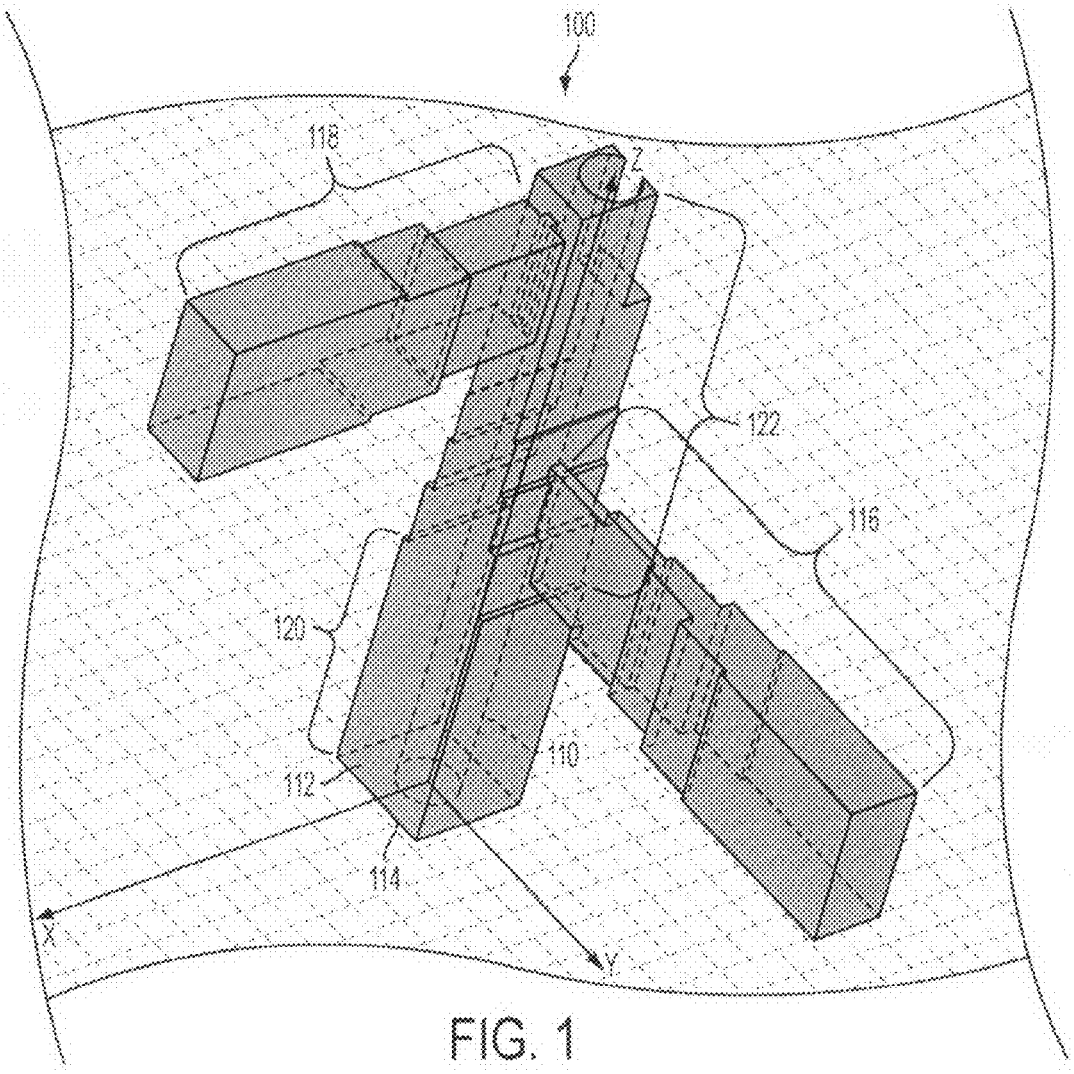
FIG. 1 illustrates a perspective view of a coaxial OMT with improved port to port isolation, low HOM coupling, and low TEM mode coupling according to at least one embodiment of the invention.

The following description is intended to convey a thorough understanding of the embodiments described by providing a number of specific embodiments and details involving a coaxial OMT with improved port to port isolation, low HOM coupling, and low TEM coupling. It should be appreciated, however, that the embodiments of the present inventions are not limited to these specific embodiments and details, which are exemplary only. It is further understood that one possessing ordinary skill in the art, in light of known devices, would appreciate the use of the various embodiments for their intended purposes and benefits in any number of alternative embodiments, depending upon specific design applications and/or other needs or preferences.

Communication systems may include a satellite adapted for orbiting the earth and an earth station. Communication may be established by an earth station transmitting and receiving electromagnetic signals to and from a satellite. According to an exemplary embodiment, the electromagnetic signals may be in the C band frequency range and/or Ku band frequency range. The C band frequency range may include electromagnetic signals with low frequencies, thus the electromagnetic signals may be associated with longer wavelengths. The Ku band frequency range may include electromagnetic signals with high frequencies, thus the electromagnetic signals may be associated with shorter wavelengths.

According to various exemplary embodiments, electromagnetic signals may be in the C band frequency range, Ku band frequency range, Ka band frequency range, and/or any other frequency ranges. A C band frequency range may include a range of frequencies from approximately 3.4 GHz to approximately 4.2 GHz. A C band frequency range may also include a range of frequencies from approximately 5.9 GHz to approximately 6.7 GHz. A Ku band frequency range may include a range of frequencies from approximately 10.7 GHz to approximately 14.5 GHz. A Ku band frequency range may also include a range of frequencies from approximately 17.3 GHz to approximately 17.8 GHz. A Ka band frequency range may include a range of frequencies from approximately 18.3 GHz to approximately 22.2 GHz. A Ka band frequency range may also include a range of frequencies from approximately 27.0 GHz to approximately 31.0 GHz. Other frequency ranges may be realized.

Figure 2:
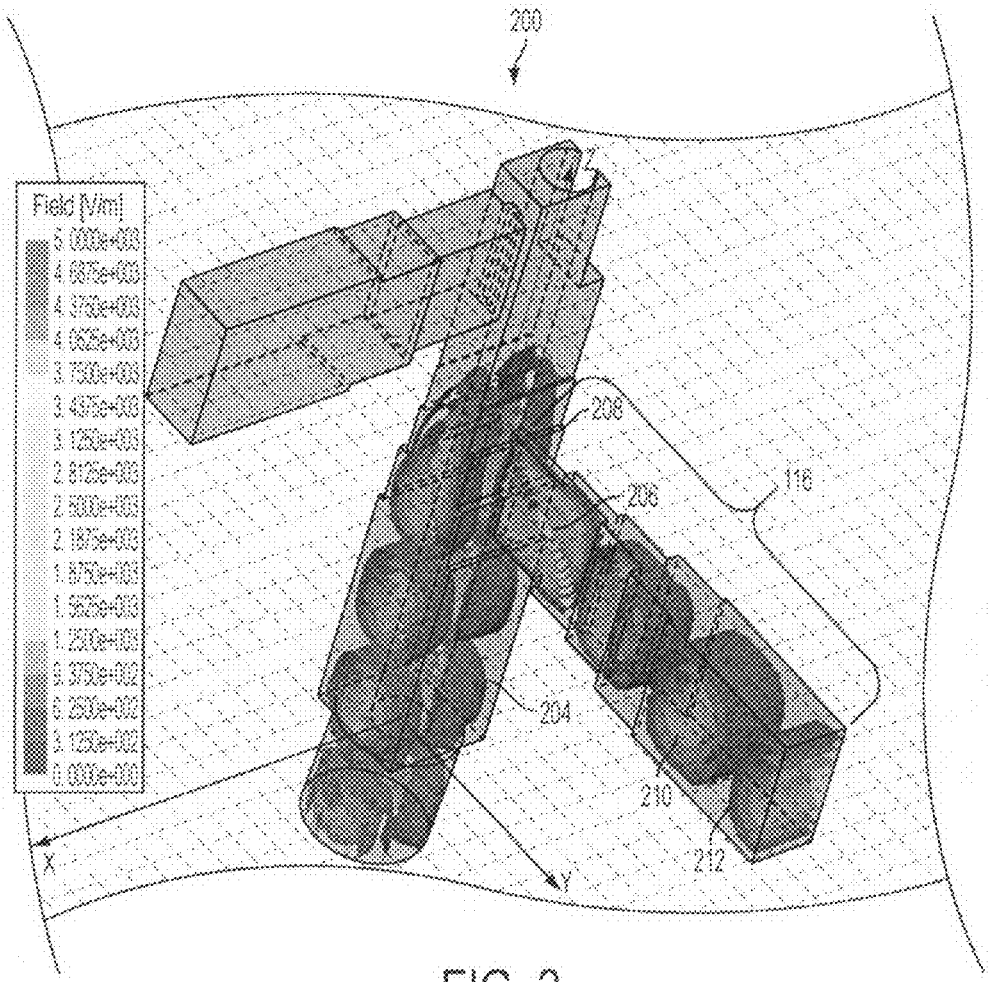
FIG. 2 illustrates a perspective view of a coaxial OMT showing common port to front port coupling according to at least one embodiment of the invention.
Figure 3:
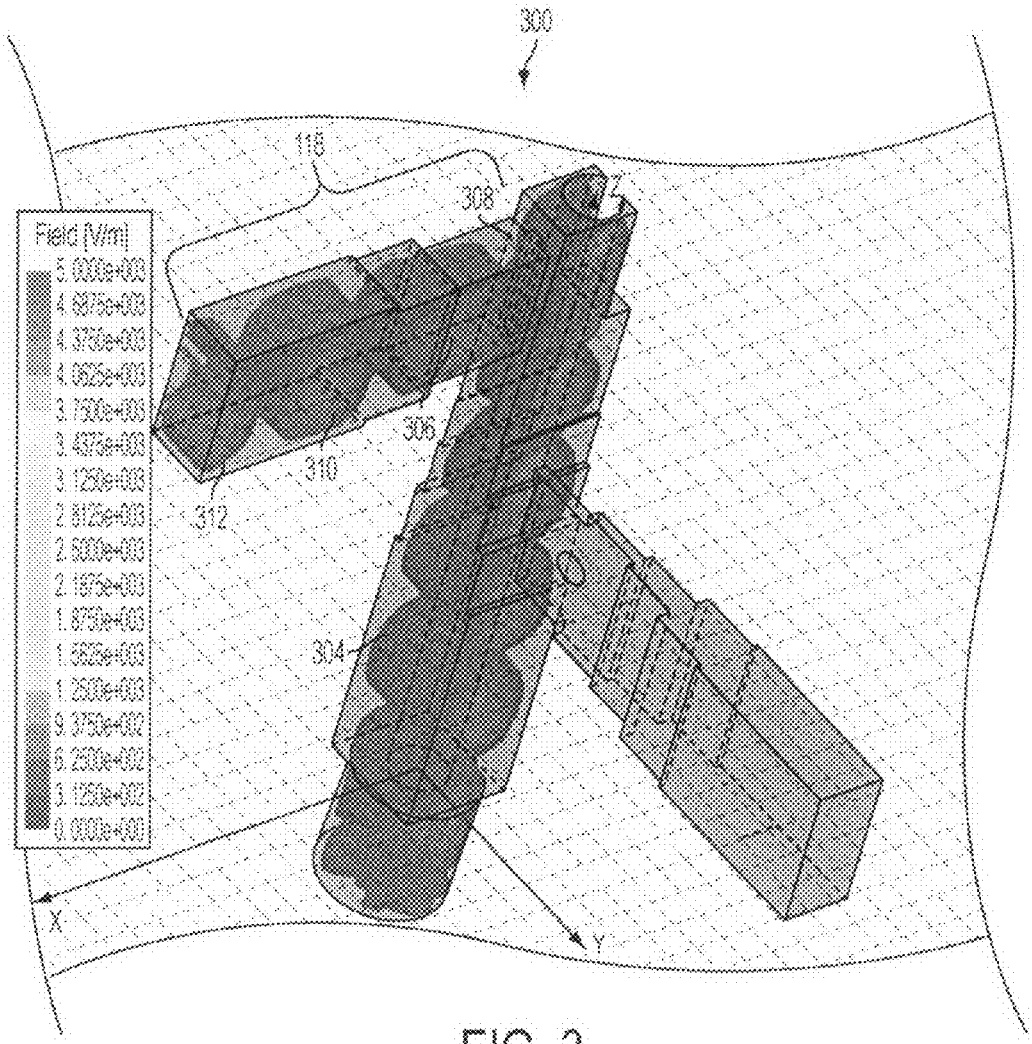
FIG. 3 illustrates a perspective view of a coaxial OMT showing common port to rear port coupling according to at least one embodiment of the invention.

An embodiment of the present invention discloses a design of a coaxial OMT that may use axially separate ports and a homogeneous transformer to achieve a substantial improvement in port to port isolation, low HOM coupling, and/or low TEM mode coupling. FIG. 1 illustrates the overall geometry of a coaxial OMT of an embodiment of the present invention. FIG. 2 illustrates the coupling of the front port of an embodiment of the present invention. FIG. 3 illustrates the coupling of the rear port of an embodiment of the present invention.

Referring now to FIG. 1, a perspective view of a coaxial OMT 100 with improved port to port isolation, low HOM coupling, and low TEM mode coupling according to at least one embodiment of the invention is illustrated. Coaxial OMT may include a first port associated with common port 114, a second port associated with front port 116, and/or a third port associated with rear port 118.

Common port 114 may include a hollow cylindrical inner portion 110 coaxially arranged with a rectangular outer portion 112 longitudinally extending from one end of common port 114 to an opposite end of common port 114. For example, cylindrical inner portion 110 may have a diameter of approximately 0.93 inches. Based on various applications and design preferences, cylindrical inner portion 110 may have other diameters and/or measurements.

Rectangular outer portion 112 may have a height of approximately 1.8 inches and width of approximately 1.8 inches in first rectangular portion 120 of rectangular outer portion 112. In various embodiments, first rectangular portion 120 may have other heights and/or widths. As illustrated in FIG. 1, first rectangular portion 120 of rectangular outer portion 112 may be coupled to portion 122, which may include one or more additional rectangular portions having heights and/or widths less than first rectangular portion 120. First rectangular portion 120 and portion 122 may be optimized to form a multi-step transformer resulting in an increase in common to rear port 118 coupling. Other variations may be realized. For example, portion 122 may include a tapered section. In another embodiment, portion 122 may be substantially the same width as first rectangular portion 120. In yet another embodiment, portion 122 may have a different shape where first rectangular portion 120 has a rectangular shape and portion 122 has a cylindrical shape.

Cylindrical inner portion 110 of common port 114 may propagate horizontally polarized and/or vertically polarized electromagnetic signals associated with high frequencies. For example, cylindrical inner portion 110 may propagate horizontally polarized and/or vertically polarized electromagnetic signals associated with Ku band frequencies. In various embodiments, other frequency bands may be determined to be high band frequencies.

Rectangular outer portion 112 of common port 114 may propagate horizontally polarized and/or vertically polarized electromagnetic signals associated with low frequencies. For example, rectangular outer portion 112 may propagate horizontally polarized and/or vertically polarized electromagnetic signals associated with C band frequencies. In various embodiments, other frequency bands may be determined to be low band frequencies.

Based on the electromagnetic properties of the hollow cylindrical inner portion 110 coaxially arranged with rectangular outer portion 112, common port 114 may be implemented such that HOM's in the frequency band of interest may not propagate. Additionally, rectangular outer portion 112 of common port 114 may also be implemented such that coaxial OMT 100 may be less susceptible to the generation of the undesired TEM mode as well. For example, using a homogeneous impedance transformer may provide a matched transmission line from common port 114 to rear port 118. In addition, impedance transformation may be designed such that orthogonal, HOM or TEM modes may not exist due to the physics of the geometry. Reflections over a frequency band of interest may also be minimized due to optimized impedance matching characteristics of a transformer.

According to various exemplary embodiments, cylindrical inner portion 110 may be implemented as another shape other than cylindrical based on various design preferences. For example, rectangular outer portion 112 may be implemented as another shape other than rectangular based on various design preferences and/or other applications. For example, other shapes may include polygonal, triangular, trapezoidal, ovular, square, and/or other shapes.

Common port 114 may be coupled to front port 116. Front port 116 may include a rectangular or other shape. Common port 114 may also be orthogonally coupled to rear port 118. Rear port 118 may include a rectangular or other shape. Front port 116 may be orthogonally coupled to rear port 118. Additional ports may be implemented. Further, front port 116 and rear port 118 may be coupled in different portions relative to common port 114.

Front port 116 may include a hollow rectangular conductor axially extending from common port 114. For example, front port 116 may axially extend from common port 114 to an opposite end of front port 116. Front port 116 may be configured to propagate horizontally and/or vertically polarized electromagnetic signals received from a substantially rectangular opening in common port 114. For example, substantially all horizontally and/or vertically polarized electromagnetic signals may be diverted from common port 114 and directed through front port 116. In addition, front port 116 may propagate horizontally and/or vertically polarized electromagnetic signals associated with high frequencies and/or low frequencies. For example, front port 116 may propagate horizontally and/or vertically polarized electromagnetic signals associated with C band frequencies, Ku band frequencies, and/or other frequency bands. While front port 116 is illustrated as having a rectangular shape, other shapes and configurations may be realized. In addition, front port 116 may include a plurality of rectangular portions forming a stepped-structure and/or other structures, such as tapered, rounded, etc. may be implemented.

Rear port 118 may also include a hollow rectangular conductor axially extending from common port 114. For example, rear port 118 may axially extend from common port 114 to an opposite end of rear port 118. Rear port 118 may be configured to propagate horizontally and/or vertically polarized electromagnetic signals received from a substantially rectangular opening in common port 114. For example, substantially all horizontally and/or vertically polarized electromagnetic signals may be directed through rear port 118 using the multi-step transformer connecting rear port 118 to common port 114. In addition, rear port 118 may propagate horizontally and/or vertically polarized electromagnetic signals associated with high frequencies and/or low frequencies. For example, rear port 118 may propagate horizontally and/or vertically polarized electromagnetic signals associated with C band frequencies, Ku band frequencies, and/or other frequency bands. While rear port 118 is illustrated as having a rectangular shape, other shapes and configurations may be realized. In addition, rear port 118 may include a plurality of rectangular portions forming a stepped-structure and/or other structures, such as tapered, rounded, etc. may be implemented.

According to various exemplary embodiments, front port 116 and rear port 118 may be configured to propagate orthogonally opposite polarized electromagnetic signals. For example, front port 116 may propagate horizontally polarized electromagnetic signals and rear port 118 may propagate vertically polarized electromagnetic signals. In addition, front port 116 may propagate vertically polarized electromagnetic signals and rear port 118 may propagate horizontally polarized electromagnetic signals.

Coaxial OMT 100 may be manufactured using a conductive material, such as, an aluminum material. In various embodiments, coaxial OMT 100 may be manufactured using aluminum, zinc, magnesium, brass, and/or any other conductive material. In addition, coaxial OMT 100 may be manufactured using alloys common to the casting industry. For example, alloys may include Zamak 3, ZA-12, A380, A383, B390, and/or any other alloy material.

Referring now to FIG. 2, a perspective view of a coaxial OMT 200 showing common port to front port coupling according to at least one embodiment of the invention is illustrated. As previously discussed, a front port 116 may be axially coupled to a common port (e.g., common port 114). Front port 116 may be configured to propagate horizontally and/or vertically polarized electromagnetic signals 204 received from opening 208 in a common port. Opening 208 may be a substantially rectangular or other shape/configuration. For example, substantially all horizontally and/or vertically polarized electromagnetic signals 204 may be diverted from a common port and directed through front port 116 resulting in a substantial improvement in port to port isolation.

Polarized electromagnetic signals may have varying degrees of field strength. For example, portion 206 of a polarized electromagnetic signal may indicate a field strength of approximately 2.5000e+003 V/m. Portion 210 of a polarized electromagnetic signal may indicate a field strength of approximately 1.5625e+003 V/m. Portion 212 of a polarized electromagnetic signal may also indicate a field strength of approximately 3.1250e+002 V/m. In addition, field strengths may depend on power levels associated with electromagnetic signals received and/or transmitted by coaxial OMT 200.

In various embodiments, front port 116 may propagate horizontally and/or vertically polarized electromagnetic signals associated with high frequencies and/or low frequencies. For example, front port 116 may propagate horizontally and/or vertically polarized electromagnetic signals associated with C band frequencies, Ku band frequencies, and/or other frequency bands.

Referring now to FIG. 3, where a perspective view of a coaxial OMT 300 showing common port to rear port coupling according to at least one embodiment of the invention is illustrated. As previously discussed, a rear port 118 may be axially coupled to a common port (e.g., common port 114). Rear port 118 may be configured to propagate horizontally and/or vertically polarized electromagnetic signals 304 received from opening 308 in a common port. Opening 308 may be a substantially rectangular opening or other shape/configuration. For example, substantially all horizontally and/or vertically polarized electromagnetic signals 304 may be diverted from a common port and directed through rear port 118 using the multi-step transformer configuration of a common port resulting in a substantial improvement in port to port isolation.

Polarized electromagnetic signals may have varying degrees of field strength. For example, portion 306 of a polarized electromagnetic signal may indicate a field strength of approximately 2.5000e+003 V/m. Portion 310 of a polarized electromagnetic signal may indicate a field strength of approximately 1.5625e+003 V/m. Portion 312 of a polarized electromagnetic signal may also indicate a field strength of approximately 3.1250e+002 V/m. In addition, field strengths may depend on power levels associated with electromagnetic signals received and/or transmitted by coaxial OMT 300.

In various embodiments, rear port 118 may propagate horizontally and/or vertically polarized electromagnetic signals associated with high frequencies and/or low frequencies. For example, rear port 118 may propagate horizontally and/or vertically polarized electromagnetic signals associated with C band frequencies, Ku band frequencies, and/or other frequency bands.

Figure 4:
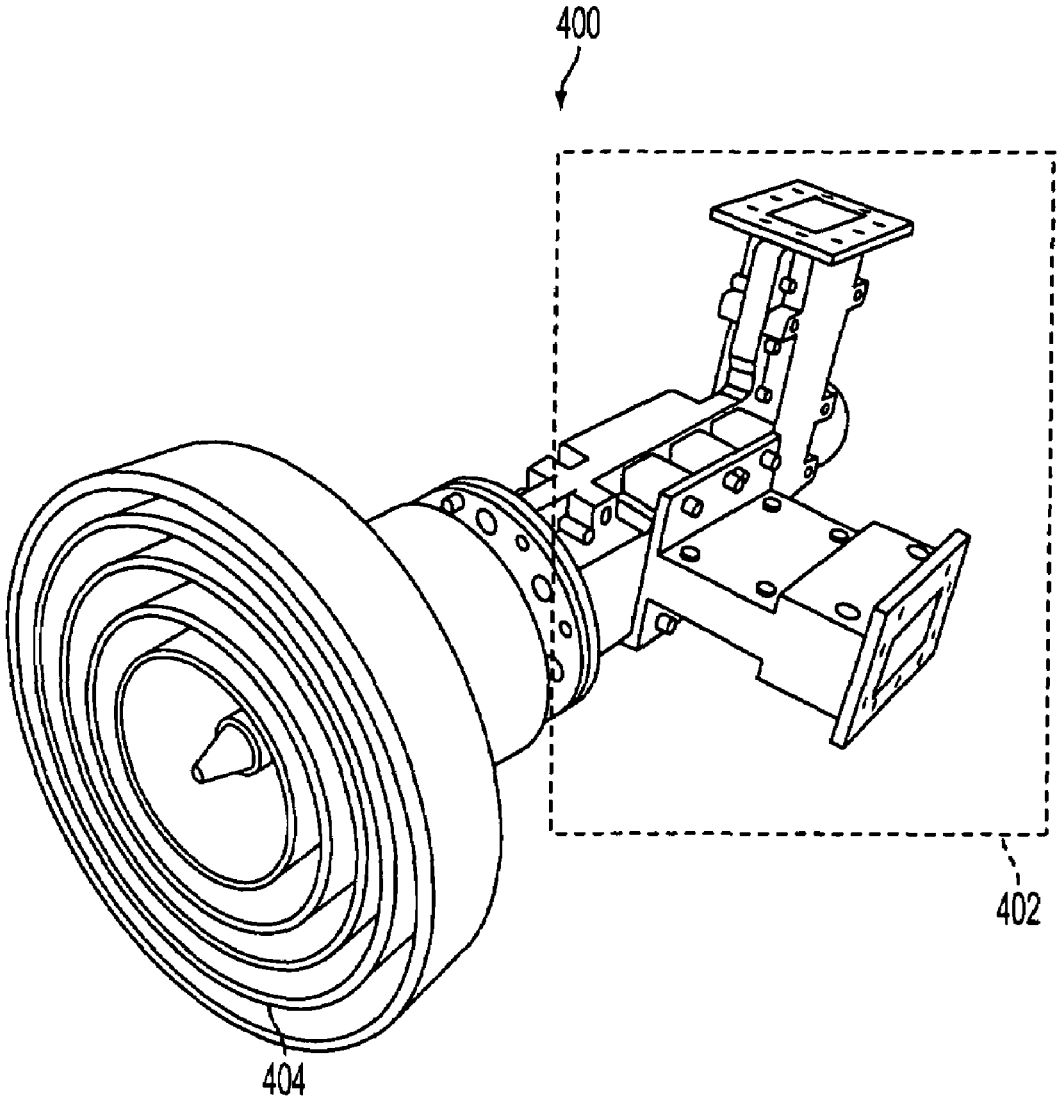
FIG. 4 is an exemplary illustration of a single aperture multi-band antenna feed according to at least one embodiment of the invention.

Referring now to FIG. 4, where an exemplary depiction of a single aperture multi-band antenna feed 400 according to at least one embodiment of the invention is illustrated. As illustrated in FIG. 4, corrugated horn 404 may be attached to a receiving end of single aperture multi-band antenna feed 400. Single aperture multi-band antenna feed 400 may also include coaxial OMT 402 for improved port to port isolation, low HOM coupling, and/or low TEM mode coupling. In various embodiments, a single aperture multi-band antenna feed 400 may include a polarizer between corrugated horn 404 and coaxial OMT 402 to create left hand circular polarization and/or right hand circular polarization. For example, other uses for a single aperture multi-band antenna feed 400 may include terrestrial communication links and/or non-radiating applications involving transfer of electromagnetic energy.

In various embodiments, the improved coaxial OMT disclosed in the embodiments of the present inventions minimizes the use of tuning screws for the design and implementation of single aperture multi-band antenna feeds. Coaxial OMT's with two concentric circular conductors and axially separate ports may utilize multiple tuning screws to improve the return loss and minimize HOM and TEM mode coupling. This method of tuning, however, may have limited effectiveness and may be time consuming leading to additional expense.

In various embodiments, the improved coaxial OMT may be used for military purposes, commercial purposes, research purposes, or any other purpose requiring a coaxial OMT with improved port to port isolation, low HOM mode coupling, and/or low TEM mode coupling. For example, the coaxial OMT disclosed herein may be implemented on the ground, in motion, and/or airborne. Other applications and uses may be realized.

It should be noted that this depiction is an example of how the various embodiments may be used.

While the foregoing description includes many details and specificities, it is to be understood that these have been included for purposes of explanation only, and are not to be interpreted as limitations of the present inventions. Many modifications to the embodiments described above can be made without departing from the spirit and scope of the inventions.

The embodiments of the present inventions are not to be limited in scope by the specific embodiments described herein. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims. Further, although some of the embodiments of the present inventions have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breath and spirit of the embodiments of the present inventions as disclosed herein.

The invention claimed is:

1. A transducer device comprising:

a first port for receiving and propagating electromagnetic signals associated with a first polarization and electromagnetic signals associated with a second polarization, the first port comprising an inner portion coaxially arranged with an outer portion longitudinally extending from one end of the first port to an opposite end of the first port;

a second port for propagating electromagnetic signals associated with the first polarization and the second polarization wherein the second port is coupled to the first port; and a third port for propagating electromagnetic signals associated with the first polarization and the second polarization wherein the third port is coupled to the first port and orthogonal to the second port;

wherein the inner portion comprises a first shape and the outer portion comprises a second shape different from the first shape.

2. The device according to claim 1, wherein the first shape is cylindrical.

3. The device according to claim 1, wherein the second shape is rectangular.

4. The device according to claim 1, wherein electromagnetic signals associated with the first polarization comprises horizontally polarized electromagnetic signals.

5. The device according to claim 1, wherein electromagnetic signals associated with the second polarization comprises vertically polarized electromagnetic signals.

6. The device according to claim 1, wherein the first port comprises a multi-step transformer.

7. The device according to claim 6, wherein the multi-step transformer comprises a first rectangular portion associated with a first width and a first height, the first rectangular portion being coupled to one or more additional rectangular portions associated with varying widths and varying heights.

8. The device according to claim 1, wherein the inner portion of the first port propagates electromagnetic signals associated with one or more Ku band frequencies.

9. The device according to claim 1, wherein the outer portion of the first port propagates electromagnetic signals associated with one or more C band frequencies.

10. The device according to claim 1, wherein the first port is configured to transmit electromagnetic signals.

11. The device according to claim 1, wherein the first port, the second port, and the third port comprises one or more of aluminum, zinc, magnesium and brass material.

12. An antenna feed comprising:

a coaxial orthomode transducer comprising a common port coupled to a front port and orthogonally coupled to a rear port;

the common port comprising a multi-step transformer that comprises an inner portion coaxially arranged with an outer portion longitudinally extending from one end of the common port to an opposite end of the common port; and the common port configured to receive, transmit, and propagate horizontally polarized and vertically polarized electromagnetic signals;

wherein the inner portion comprises a first shape and the outer portion comprises a second shape different from the first shape.

13. The device according to claim 12, wherein the first shape is cylindrical.

14. The device according to claim 12, wherein the second shape is rectangular.

15. The device according to claim 12, wherein the front port is coupled to the common port and orthogonally coupled to the rear port.

16. The device according to claim 12, wherein the coaxial orthomode transducer comprises one or more of aluminum, zinc, magnesium, and brass material.

17. An antenna feed comprising:

a coaxial orthomode transducer comprising a common port coupled to a front port and orthogonally coupled to a rear port;

the common port comprising a multi-step transformer that comprises a cylindrical inner portion coaxially arranged with a rectangular outer portion longitudinally extending from one end of the common port to an opposite end of the common port; and the common port configured to receive, transmit, and propagate horizontally polarized and vertically polarized electromagnetic signals;

wherein the front port propagates horizontally and vertically polarized electromagnetic signals and the rear port propagates horizontally and vertically polarized electromagnetic signals.

* * * * *